US005535770A

United States Patent [19]

Nurmi

[11] Patent Number: 5,535,770

[45] Date of Patent: Jul. 16, 1996

[54] EJECTOR DEVICE

[75] Inventor: Pekka Nurmi, Espoo, Finland

[73] Assignee: EVAC AB, Bromolla, Sweden

[21] Appl. No.: 335,655

[22] Filed: Nov. 8, 1994

[30] Foreign Application Priority Data

Nov. 11, 1993 [FI] Finland ..... 934978

[51] Int. Cl.[6] ..... E03D 1/00

[52] U.S. Cl. ..... 137/14; 137/566; 137/895; 137/236.1; 4/300; 4/DIG. 9

[58] Field of Search ..... 137/565, 566, 137/236.1, 895, 14; 4/300, DIG. 9

[56] References Cited

U.S. PATENT DOCUMENTS

| | | | |
|---|---|---|---|
| 2,247,116 | 6/1941 | Day | 137/566 |
| 4,034,421 | 7/1977 | Pihl et al. | 137/566 |
| 4,188,968 | 2/1980 | Trobaugh et al. | 137/236.1 |
| 4,214,324 | 7/1980 | Kemper et al. | 4/300 |
| 4,691,731 | 9/1987 | Grooms et al. | 137/236.1 |
| 5,165,457 | 11/1992 | Olin et al. | 4/DIG. 9 |

OTHER PUBLICATIONS

Tekniikan Maailma, Jun. 1988.

*Primary Examiner*—A. Michael Chambers
*Attorney, Agent, or Firm*—Smith-Hill and Bedell

[57] ABSTRACT

A vacuum sewer system comprises a liquid-driven ejector, the working medium of which is fed to the ejector by a circulation pump from a sewage collecting container, the suction side of the ejector being connected via a check valve to a vacuum sewer network. Air and sewage delivered through the sewer network flow through the ejector into the collecting container. The bore of the discharge pipe of the ejector is substantially cylindrical throughout. Its length is 8 to 20, preferably 10 to 15, times the diameter of its bore and the pipe discharges directly into the open interior of the collecting container.

21 Claims, 2 Drawing Sheets

1
1a
2
1
1a
2
1
1a
2
2
2
25
24
4
9
10
2a
5
h
d
11
22
3
8
15
16b
14
16a
13
6
7
12

EJECTOR DEVICE

BACKGROUND OF THE INVENTION

The invention relates to a vacuum generating means for a vacuum sewer system and inn particular to the use of an ejector as a vacuum pump in such a sewer system.

Ejectors have long been used as a source of partial vacuum in vacuum sewer systems. Such an arrangement is shown in U.S. Pat. No. 4,034,421. According to this known art, the working medium of the ejector is a flow of liquid fed by a circulation pump to the ejector from a sewage collecting container. The total efficiency rate of such a vacuum generating means is only about 5 percent. This is because the efficiency rate of the circulation pump is about 40 percent and only about 10 percent to 15 percent of its useful power can be utilized in the ejector that it drives. An improvement in the efficiency rate of the vacuum generating means is, however, not usually of any great importance per se.

Improving the total efficiency rate of a liquid-driven ejector working as an air pump has been the subject of extensive research. Nevertheless, the aim of the present invention is not to improve the efficiency rate of the ejector. This invention is based on the idea that in the special application of an ejector as the vacuum generating means for a vacuum sewer system it is more important to maximize the air flow drawn into the ejector at a sufficiently high vacuum level (higher vacuum=smaller absolute pressure). In a vacuum generating means according to the invention, the ejector discharges directly into the sewage collecting container (e.g. at atmospheric pressure). Under these circumstances the pressure and the kinetic energy of the mass flow from the ejector are not utilized at all and this has a decisive influence on the optimizing of the function of the ejector.

SUMMARY OF THE INVENTION

One aim of the invention is to optimize the function of a vacuum generating means using a liquid-driven ejector, the working medium of which is fed to the ejector by a circulation pump from a sewage collection container, the suction side of the ejector being connected to the sewer network via a check valve, so that air and sewage are drawn into the collecting container from the sewer network through the ejector. It is important that a sufficiently high vacuum is generated by the ejector and that at the same time the volume rate of air flow through the ejector is maximized. A typical vacuum level in a vacuum sewer system is about one half of atmospheric pressure, but considerable variations from this vacuum level occur in different applications.

In accordance with the present invention, the diffuser that is traditionally used in an ejector and provides a conically enlarging end portion of the discharge pipe in the flow direction is not employed. To the contrary, the ejector has a discharge pipe of which the bore is substantially cylindrical throughout its length. The length of the discharge pipe should be 8 to 20, preferably 10 to 15, times the diameter of its bore. It is also important that the ejector, as known per se, discharges directly into the open interior of the collecting container and not into a pipe connected to the collecting container since such a pipe could be narrow enough to affect the functioning of the ejector. It is feasible for the outlet end of the discharge pipe to be connected to the open interior of the collecting container through a connecting pipe, provided that the connecting pipe is wide enough and flares at a steep enough angle from the outlet end of the discharge pipe that it does not disturb the free flow of fluid (liquid and gas) from the discharge pipe into the collecting container. In this case, the connecting pipe may be considered as an extension or enlargement of the collecting container.

It has been found that a vacuum generating means utilizing an ejector constructed in the manner described, operates considerably better in the operational environment of a vacuum sewer system than a corresponding traditional ejector-based vacuum generating means.

In some applications, an ejector-based vacuum generating means employs multiple ejectors. It has been found that, in some applications, a vacuum generating means according to the invention having only two ejectors provides the same function as a traditional ejector-based vacuum generating means having as many as five ejectors. This is in spite of the fact that the theoretical efficiency rate of the ejector used in a vacuum generating means according to the invention is possibly inferior to the efficiency rate of known ejectors.

When applying the invention, it is of advantage that the pressure generated by the circulation pump, just upstream of the ejector, is at least 1.5 bar (gauge), preferably at least 1.9 bar (gauge). The use of such a high supply pressure enhances the air pumping capacity of the ejector and the flow rate of the working medium through the ejector. Thus, it is recommended that the rate of flow from the circulation pump to the ejector is at least 90 $m^3/h$, preferably about 100 $m^3/h$ or more.

In order to obtain a sufficiently high pumping capacity in the ejector, it is of advantage that the cross-sectional area of the bore of the discharge pipe of the ejector is at least 2.2 times, preferably at least 2.5 times, the area of the smallest aperture in the nozzle of the ejector through which the working medium flows to generate the required partial vacuum in the suction chamber of the ejector. These values are advantageous especially in combination with the above-mentioned values for the pressure and the flow rate of the working medium used in the ejector. The ratio of the cross-sectional area of the bore of the discharge pipe of the ejector to the minimum cross-sectional area of the nozzle of the ejector should not be so great that a sufficiently high vacuum cannot be generated by the ejector. A suitable maximum value is usually about 3 to 3.5.

In a conventional ejector used in a vacuum generating means for a vacuum sewer system, the angle of the end portion of the sewer pipe relative to the longitudinal axis of the ejector is usually about 90°. In accordance with the invention, the pumping capacity of the ejector is advantageously affected by using an inclined connection of the end portion of the vacuum sewer to the suction chamber of the ejector so as to reduce the change in direction of flow of material drawn through the ejector. The angle of the end portion of the sewer pipe relative to the longitudinal axis of the ejector is desirably 45°±20°, preferably 45°±10°.

Because a vacuum generating means according to the invention may have to operate in different vacuum sewer systems under different operational circumstances, it is desirable that the characteristics of the ejector can be adjusted so that in any application the ejector operates at or close to its optimum performance. The desired vacuum level and the amounts of air and sewage to be pumped may vary considerably in different applications. Because the characteristics of an ejector cannot be adjusted by means of a simple adjustment device, the ejector is preferably so devised that its nozzle and discharge parts, are removably attachable to other structures of the elector, so that by exchanging them for other parts, the characteristics of the ejector can be modified as required.

The circulation pump may be used for two purposes. Primarily the circulation pump works as the ejector's energy source, but the sewage collecting container must be emptied from time to time, and the pump may be used for this purpose also. If a low power circulation pump is employed, the ejector must be shut down during the emptying operation by shutting off the working medium flow from the pump to the ejector. In a preferred embodiment, however, the circulation pump is so powerful that, even when the ejector is in operation, the pump is capable of pumping a part of the liquid from the collecting container to a height of at least 10 meters, and preferably at least 15 meters, above the level of the pump. In this case, it is not necessary to shut down the ejector during the emptying phase of the collecting container, and the emptying may be accomplished even when the circulation pump is simultaneously powering the ejector. This makes it possible, when applying the invention to the vacuum sewage arrangement of a ship, to empty the collecting container while the ship is in harbor without interrupting the function of the ejector.

The ejector would not normally operate continuously. Its function will be dependent on the vacuum level existing in the vacuum sewer network. The pressure rises in the sewer network whenever a W.C. toilet bowl or other device connected thereto is emptied. When the pressure in the network rises above a certain limiting level, the ejector can be started automatically and can then run until an adequate vacuum level is again attained in the sewer network. The collecting container is continuously maintained at atmospheric pressure.

The diffuser that is conventional in the discharge pipe of prior art ejectors should not be used in the ejector of a vacuum generating means according to this invention. This is because the mass flow from the ejector is freely discharged into the interior of the collecting container. If there is an obstacle, for example a wall of the collecting container, in the vicinity of the discharge area of the ejector, it may have an unfavorable influence on the functioning of the ejector, especially if the distance between the outlet end of the discharge pipe and the obstacle is small. Therefore, it is recommended that the axial clearance between the end of the discharge pipe and the closest obstacle in front thereof is at least 0.5 meters, preferably at least 1.5 meters. It is important also to keep the discharge area of the ejector free from disturbing obstructions in lateral directions (e.g. in a radial direction with respect to the discharge pipe) also. With regard to lateral clearances, the minimum desirable free (unobstructed) area is considerably smaller, usually only at least 1.5 times, and preferably twice, the diameter of the discharge pipe measured from its longitudinal axis.

A problem can be created by solid, semi-solid and fibrous matter and also rubber matter (such as condoms) present in normal sewage. For disintegrating these materials, it is known to use grinding devices, integrated in the system. It has however, been found that the use of a grinding device in a vacuum sewer network slows down, in a disadvantageous manner, the passage of sewage to the collecting container. Therefore, in a vacuum generating means according to the invention, a grinding device is not used in the sewer network itself, but instead is located in the circulation path of the circulation pump, preferably just upstream of the circulation pump. A grinding device in this location does not disturb the flows in the sewer pipe network and at the same time it considerably improves the operational conditions of the ejector and the homogeneity of its working medium. By this means the grinding device has a favorable effect on the working capacity of the entire vacuum generating means. The grinding device may, as known per se, be integrated with the circulation pump so that the drive motor of the circulation pump directly drives both the grinding device and the pump.

Because there is normally no grinding device in the sewer pipe of a vacuum generating means according to the invention, solid and semi-solid matter in the sewage may, especially when the ratio of liquid to solid matter is low, cause clogging of the ejector. Normally, this happens very rarely, but for improved security and reliability it is recommended that in the housing of the ejector, or at the point where the vacuum sewer network joins the ejector, there is an inspection port with an openable cover, through which any matter disturbing the function of the ejector may be removed when necessary.

BRIEF DESCRIPTION OF THE DRAWINGS

The invention will now be described more fully, by way of example, with reference to the accompanying drawings, in which.

DETAILED DESCRIPTION

Figure 1:
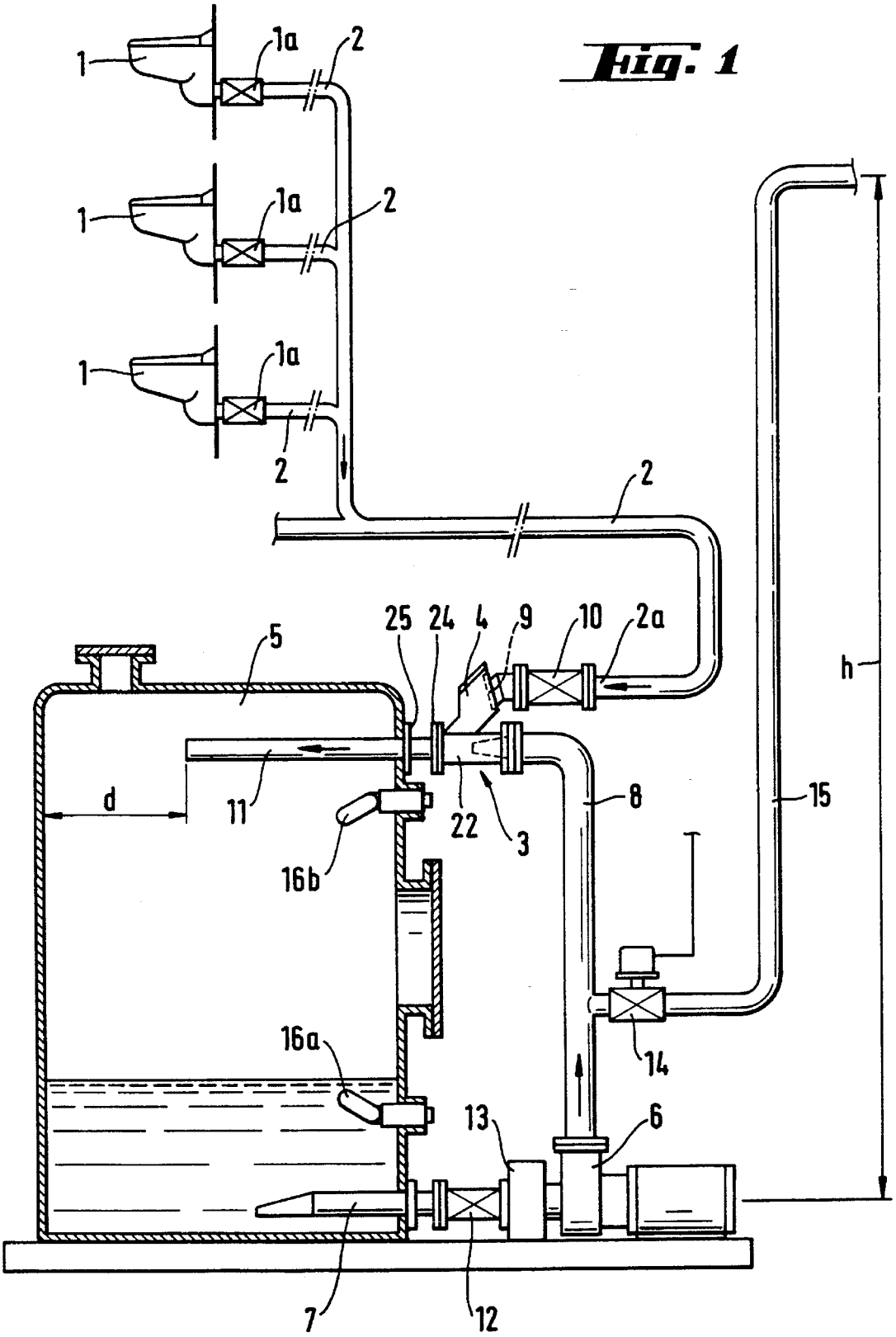
FIG. 1 schematically shows the general arrangement of a vacuum sewer system employing a vacuum generating means according to the invention, and FIG. 2 schematically shows a longitudinal section through the ejector of the system of FIG. 1.

In FIG. 1, numeral 1 indicates W.C. toilet bowls connected to respective branches of a vacuum sewer network 2. In close proximity to each toilet bowl 1 there is a normally-closed sewer valve 1*a* that directly joins the interior of that toilet bowl 1 to a sewer pipe branch. In the sewer network, a partial vacuum of about 50 percent of atmospheric pressure is generated by an ejector 3. The number of toilet bowls 1 may be up to one hundred or more per one ejector 3. A suction pipe 4 of the ejector 3 is connected to the outlet end 2*a* of the sewer network 2. The ejector 3 discharges into a sewage collecting container 5. A powerful circulation pump 6 draws the mainly liquid sewage present in the container 5 from the container through a pipe 7 and pumps it through a pipe 8 to the ejector 3, where the flow delivered by the pump 6 acts as the working medium for operating the ejector, so that a partial vacuum is first generated in the suction chamber (which includes the pipe 4) of the ejector 3 and then also in the sewer network 2. Between the outlet end 2*a* of the sewer network and the suction chamber of the ejector 3, there is a non-return valve 9 (see FIG. 2) and a normally-open shut-off valve 10. The working medium of the ejector 3 and the air and sewage drawn through the sewer network to the ejector 3 flow at high speed through a discharge pipe 11 of the ejector directly into the interior of the container 5.

Upstream of the circulation pump 6 there is a normally open shut-off valve 12 and a grinding device 13 that grinds up solid matter occurring in the sewage. The grinding device 13 may be driven by the circulation pump 6 and it may be connected to the pump. For example, the grinding device may be integrated with the pump so that it is on the same shaft as the pump rotor. The flow rate generated by the pump 6 is, in the embodiment being discussed, more than 100 $m^3/h$. The pressure in the pipe 8, just upstream of the ejector 3, is then about 2 bar (gauge). The pump 6 is capable of emptying the container 5 and driving the ejector 3 at the same time. In the emptying phase, a preferably remotely controlled emptying valve 14 is opened, whereby a proportion, for example 20 percent, of the medium flow delivered by the pump 6 flows from the pipe 8 to a pipe 15. The power of the pump 6 is high enough that, even when the ejector 3 is operating at adequate power, the medium flow pumped to the pipe 15 may rise a distance h that is about 10 to 20 meters above the level of the pump 6.

In the container 5, there are two level indicators 16*a* and 16*b*. The lower level indicator 16*a* actuates an alarm if there is too little liquid in the container and the upper level indicator 16*b* actuates an alarm when the liquid level rises so high that the container 5 requires emptying. However, the sewer system illustrated is operable even if the liquid level in the container 5 rises above the level set by the upper level indicator 16*b* and even in the case that the discharge pipe 11 of the ejector 3 is partly or totally below the liquid level in the container 5. Normally, however, the liquid level should always be clearly below the discharge pipe 11 of the ejector 3, for instance a distance of 1.5 to 2 times the diameter of the bore of the discharge pipe below the longitudinal axis of the discharge pipe. The distance d from the outlet end of the discharge pipe 11 to the closest wall (or other obstacle) in front of it should not be less than a certain minimum distance which is recommenced to be 0.5 meters, increasing to 1.0 meters in the case of an ejector operating at the highest ejector power contemplated.

A vacuum generating means according to the invention may be advantageously used, for example, in a large passenger ship. In this case about 200 W.C. toilet bowls may be connected to one sewer network powered by a single ejector. Several ejector arrangements according to FIG. 1, each including its own circulation pump 6, can be connected to feed into the same collecting container 5. In this case, all the ejectors are conveniently connected through one common pipe or manifold to the same sewer network 2. The collecting container 5 usually has a volume of 10 $m^3$ or more and is maintained at atmospheric pressure. It is not necessary that all the ejectors 3 connected to a single collecting container 5 be able to provide a collection-container-emptying facility unless it is necessary to increase the emptying speed by using several circulation pumps 6 simultaneously for emptying the collecting container 5.

Figure 2:
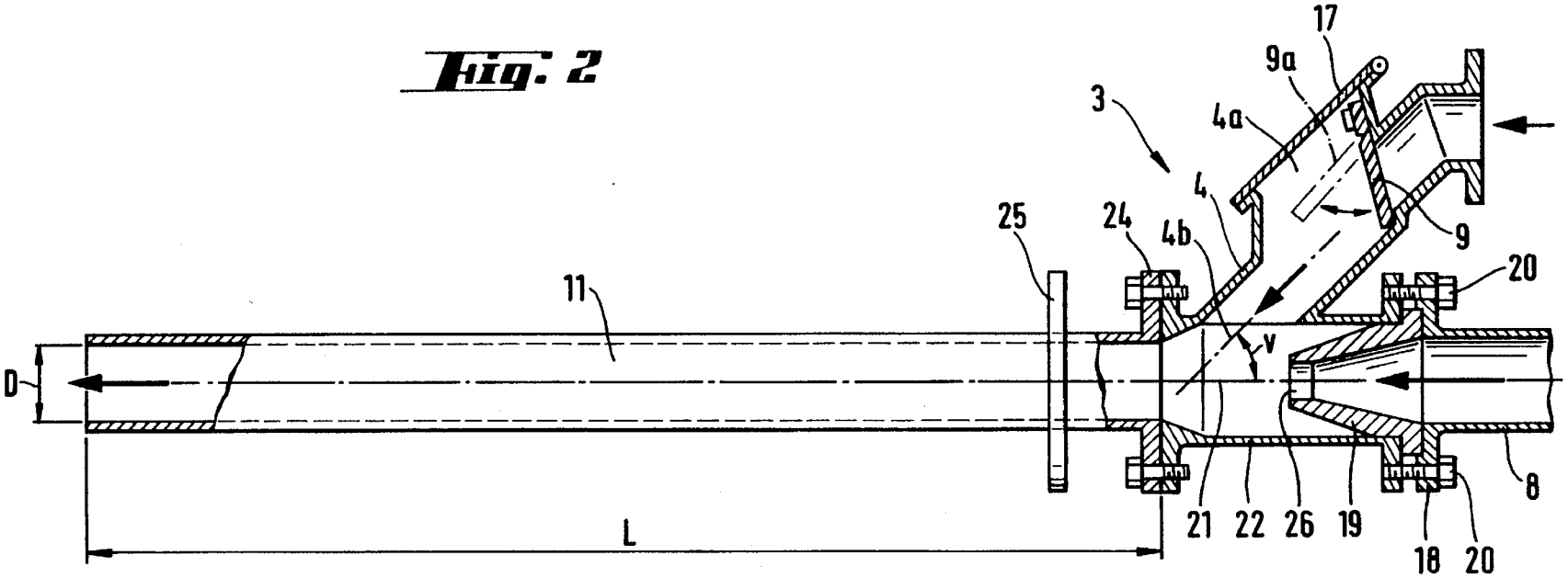

The component parts of the ejector 3 are shown in greater detail in FIG. 2. The check valve 9 in the suction pipe 4 of the ejector 3 has the form of a flexible rubber flap that, when the ejector is running, is deflected upwards into a position 9*a* in an enlargement 4*a* of the suction pipe 4. A detachable inspection cover 17 is provided in the casing of this enlargement. Removal of the cover 17 provides free access to the interior of the suction chamber of the ejector.

The delivery pipe 8 for the working medium of the ejector 3 terminates in a flange 18. A nozzle member 19 is held between the flange 18 and a flange of the ejector casing 22 by screw bolts 20. Hence, the nozzle member 19 is easily exchangeable for a different nozzle, should one wish to change the characteristics of the ejector. The angle v between the longitudinal axis 21 of the ejector and the longitudinal axis 4*b* of the suction pipe 4 is about 45° in the embodiment illustrated.

The cylindrical discharge pipe 11 of the ejector 3 is attached to the ejector casing 22 by means of a flange connection 24. The discharge pipe 11 is thus easily removable and exchangeable, if, for example, an exchange of the nozzle member 19 requires the use of a different discharge pipe. The discharge pipe 11 and at the same time the whole ejector 3 is connected to the collecting container 5 by means of a flange 25, which can be adjustably mounted on the pipe 11 by means of a collar (not shown), so that it may be relocated in the longitudinal direction of the pipe 11.

The discharge pipe is circular in cross-section and its inner or bore diameter D is uniform over its length L. The length L of the discharge pipe 11 is 8 to 20, preferably 10 to 15, times its diameter D. The cross-sectional area of the free opening of the discharge pipe 11 is in the embodiment illustrated slightly more than 2.5 times the area of the smallest aperture 26 of the nozzle member 19 of the ejector 3.

The invention is not limited to the embodiment illustrated, since several modifications thereof are feasible within the scope of the following claims.

I claim:

1. A method of operating a vacuum sewer system that comprises a vacuum sewer network, a sewage collecting container defining an open interior space, and an ejector having a suction inlet, a working medium inlet, and an outlet, said method comprising pumping liquid from the sewage collecting container to the working medium inlet of the ejector as working medium, so that air and sewage in the sewer network are drawn into the ejector, and discharging fluid from the ejector into the sewage collecting container through said outlet and an elongate discharge pipe that debouches into the open interior space of the sewage collecting container, the discharge pipe defining a bore that is substantially cylindrical over the length of the discharge pipe, and the length of the discharge pipe being from about 8 to about 20 times the diameter of its bore.

2. A method according to claim 1, comprising pumping liquid from the sewage collecting container to the working medium inlet of the ejector so that the pressure generated in the working medium just upstream of the ejector is at least 1.5 bar gauge.

3. A method according to claim 1, comprising pumping liquid from the sewage collecting container to the working medium inlet of the ejector so that the pressure generated in the working medium just upstream of the ejector is at least 1.9 bar gauge.

4. A method according to claim 1, comprising pumping liquid from the sewage collecting container at a rate of at least 90 $m^3$/h.

5. A method according to claim 1, comprising pumping liquid from the sewage collecting container at a rate of at least 100 $m^3$/h.

6. A vacuum sewer system comprising:

a vacuum sewer network, a sewage collecting container defining an open interior space, an ejector having a suction inlet, a working medium inlet, and an elongate discharge pipe that debouches into the open interior space of the sewage collecting container, a check valve connected between the vacuum sewer network and the suction inlet of the ejector, and a circulating pump connected between the sewage collecting container and the working medium inlet of the ejector for supplying liquid from the sewage collecting container to the ejector as working medium, so that air and sewage in the sewer network are drawn into the ejector through the check valve and are discharged into the sewage collecting container through the discharge pipe, and wherein the discharge pipe defines a bore that is substantially cylindrical over the length of the discharge pipe and the length of the discharge pipe is from about 8 to about 20 times the diameter of the bore.

7. A vacuum sewer system according to claim 6, wherein the pressure generated in the working medium just upstream of the ejector by the circulation pump is at least 1.5 bar gauge.

8. A vacuum sewer system according to claim 6, wherein the pressure generated in the working medium just upstream of the ejector by the circulation pump is at least 1.9 bar gauge.

9. A vacuum sewer system according to claim 6, wherein the flow of working medium fed to the ejector by the circulation pump is at least 90 $m^3/h$.

10. A vacuum sewer system according to claim 6, wherein the flow of working medium fed to the ejector by the circulation pump is at least 100 $m^3/h$.

11. A vacuum sewer system according to claim 6, wherein the ejector comprises a nozzle for the working medium and the free cross-sectional area of the bore of the discharge pipe of the ejector is at least 2.2 times the cross-sectional area of the smallest aperture of the nozzle.

12. A vacuum sewer system according to claim 6, wherein the ejector comprises a nozzle for the working medium and the free cross-sectional area of the bore of the discharge pipe of the ejector is at least 2.5 times the cross-sectional area of the smallest aperture of the nozzle.

13. A vacuum sewer system according to claim 6, wherein the suction inlet of the ejector defines an axis that is at an orientation directed towards the discharge pipe of the ejector and is inclined at an angle of 45°±20° to the longitudinal axis of the discharge pipe.

14. A vacuum sewer system according to claim 6, wherein the suction inlet of the ejector defines an axis that is at an orientation directed towards the discharge pipe of the ejector and is inclined at an angle of 45°±10° to the longitudinal axis of the discharge pipe.

15. A vacuum sewer system according to claim 6, wherein the ejector comprises a nozzle member and the nozzle member and the discharge pipe are removably attached to other structural parts of the ejector so as to be interchangeable with other parts for changing the pumping characteristics of the ejector.

16. A vacuum sewer system according to claim 6, wherein the power of the circulation pump is so chosen relative to the required working medium flow of the ejector, that even when the ejector is operating as a vacuum generator, it is capable of pumping a part of the contents of the collection container to a height that is at least 10 m above the level of the pump.

17. A vacuum sewer system according to claim 6, wherein the power of the circulation pump is so chosen relative to the required working medium flow of the ejector, that even when the ejector is operating as a vacuum generator, it is capable of pumping a part of the contents of the collection container to a height that is at least 15 m above the level of the pump.

18. A vacuum sewer system according to claim 6, wherein the clearance between the outlet end of the discharge pipe of the ejector and the closest obstruction in front thereof is at least 0.5 m.

19. A vacuum sewer system according to claim 6, wherein the clearance between the outlet end of the discharge pipe of the ejector and the closest obstruction in front thereof is at least 1.0 m.

20. A vacuum sewer system according to claim 6, wherein upstream of the circulation pump there is a grinding device that grinds up sewage flowing into the circulation pump.

21. A vacuum sewer system according to claim 6, wherein the ejector has an openable inspection cover to facilitate access to the interior of the ejector.

* * * * *